US006250060B1

(12) United States Patent
Scheerer et al.

(10) Patent No.: US 6,250,060 B1
(45) Date of Patent: Jun. 26, 2001

(54) METHOD OF PRODUCING IMPROVED KNIT FABRICS FROM BLENDED FIBERS

(75) Inventors: Todd Joseph Scheerer; Winston Patrick Moore, both of Charlotte, NC (US)

(73) Assignee: Wellman, Inc., Shrewsbury, NJ (US)

( * ) Notice: Subject to any disclaimer, the term of this patent is extended or adjusted under 35 U.S.C. 154(b) by 0 days.

(21) Appl. No.: 09/112,712

(22) Filed: Jul. 9, 1998

Related U.S. Application Data

(63) Continuation-in-part of application No. 08/844,463, filed on Apr. 18, 1997, now Pat. No. 5,950,413, and a continuation-in-part of application No. 08/997,147, filed on Dec. 23, 1997, now Pat. No. 5,970,700.

(51) Int. Cl.[7] ..... D01H 5/28

(52) U.S. Cl. ..... 57/328; 57/315; 57/333; 19/236

(58) Field of Search ..... 57/315, 328, 333; 19/236, 256, 260, 261

(56) References Cited

U.S. PATENT DOCUMENTS

| | | | | |
|---|---|---|---|---|
| 3,105,998 | * | 10/1963 | Raboisson | 19/244 |
| 3,596,456 | * | 8/1971 | Quick | 56/130 |
| 3,686,850 | * | 8/1972 | Thomson | 57/157 R |
| 4,088,016 | * | 5/1978 | Watson et al. | 73/160 |
| 4,369,622 | * | 1/1983 | Teed et al. | 57/315 |
| 4,387,487 | * | 6/1983 | Nakahara et al. | 19/249 |
| 4,632,874 | | 12/1986 | Smith . | |
| 4,644,609 | * | 2/1987 | Lattner | 19/244 |
| 4,667,463 | * | 5/1987 | Minorikawa et al. | 57/328 |
| 5,400,476 | * | 3/1995 | White | 19/239 |
| 5,467,512 | | 11/1995 | Weingarten et al. . | |
| 5,477,595 | | 12/1995 | Weingarten et al. . | |
| 5,481,863 | * | 1/1996 | Ota | 57/328 |
| 5,515,699 | | 5/1996 | Weingarten et al. . | |
| 5,515,700 | | 5/1996 | Weingarten et al. . | |

FOREIGN PATENT DOCUMENTS

| | | | |
|---|---|---|---|
| 340743 | | 1/1999 | (CH) . |
| 4225243 | * | 2/1993 | (DE) . |
| 4308392 | * | 9/1993 | (DE) . |
| 222981 | * | 8/1986 | (EP) . |
| 0604973 | | 7/1994 | (EP) . |
| 2268096 | * | 4/1975 | (FR) . |
| 7-133536 | | 5/1995 | (JP) . |
| 7-189063 | * | 7/1995 | (JP) . |

* cited by examiner

*Primary Examiner*—John J. Calvert
*Assistant Examiner*—Gary L. Welch
(74) *Attorney, Agent, or Firm*—Philip Summa, P.A.

(57) ABSTRACT

A high efficiency method of producing a high quality knit fabricis diclosed. The method includes the steps of drafting a blended sliver of cotton fibers and polyester fibers in a four roll draffing zone in which the nip to nip spacing in the break zone is no more than 2.5 mm longer than the effective fiber length of the polyester fibers, and no more than 1.5 mm greater than the effective fiber length in the intermediate zone, and at least 7 mm greater than the effective fiber length in the front zone, thereafter spinning the drafted sliver into yarn at a take up speed of greater than 150 meters per minute, and thereafter knitting the spun yarn into fabric.

32 Claims, 6 Drawing Sheets

METHOD OF PRODUCING IMPROVED KNIT FABRICS FROM BLENDED FIBERS

FIELD OF THE INVENTION

This application is a continuation-in-part of co-pending applications Ser. No. 08/844,463 filed Apr. 18, 1997 now U.S. Pat. No. 5,950,413, and Ser. No. 08/997,147 filed Dec. 23, 1997 now U.S. Pat. No. 5,970,700, both entitled "Spinning Apparatus, Method of Producing Yams, and Resulting Yarns." The present invention relates to yarn spinning and more particularly, relates to a novel method of drafting sliver in a spinning apparatus to form highly uniform yarns that produce significantly improved knit fabric appearance and hand.

BACKGROUND OF THE INVENTION

One common method of forming single yarns has been the use of a spinning apparatus which drafts and twists prepared strands of fibers to form the desired yarn. One of the first yarn spinning apparatus was the mule spinning frame which was developed in 1782 and used for wool and cotton fibers. Many decades later, the ring spinning apparatus was developed to increase the spinning speed and quality of the spun yarn. Although good quality natural yarns may be produced by ring spinning, the rate of ring spinning remains relatively slow, e.g., less than about 15 meters/minute. In the last few decades, other various types of spinning apparatus which operate at higher speeds than ring spinning apparatus have been introduced. For example, rotor spinning, friction spinning and air-jet spinning methods are capable of spinning sliver into yarn at speeds greatly exceeding ring spinning speeds.

Prior to spinning sliver into yarn, the fibers are typically processed by carding and other various methods and then drawn to attenuate or increase the length per unit weight of the sliver. The sliver is generally drawn in a drafting zone comprising a series of drafting roll pairs with the speed of successive roll pairs increasing in the direction of sliver movement to draw the sliver down to the point where it approaches yarn width. Numerous parameters have traditionally been adjusted in the drafting zone to attempt to maximize the drafting and quality of the sliver including draft roll spacings, draft roll diameters, draft roll speeds (ratios), draft distribution, and fiber blending (e.g., draw-frame and/or intimate blending).

One particular parameter, the draft roll spacing between adjacent roll pairs, is normally defined by the distance between the nip, ie., the line or area of contact, between one pair of rolls and the nip of an adjacent pair of rolls.

The conventional wisdom for draft roll spacings, especially for higher speed spinning processes such as air jet spinning, has been to set the distance between adjacent nips at greater than the fiber length of the staple fibers in the sliver. See, e.g., U.S. Pat. No. 4,088,016 to Watson et al. and U.S. Pat. No. 5,400,476 to White. This particular roll spacing has been widely accepted as the industry standard based on the rationale that smaller roll spacing results in increased breakage of fibers. Specifically, when the roll spacing is less than the fiber length, individual fibers may extend from one nip to an adjacent nip or bridge adjacent nips. Because adjacent pairs of rollers operate at different speeds, the bridged fibers may become pulled apart thus resulting in breakage of the fibers. This fiber breakage can result in low yarn quality and even yarn breakage in subsequent processing equipment such as spinning apparatus which may require the processing equipment to be shut down. Thus, draft roll spacings of greater than the fiber length have been the standard in the textile industry. The standard draft roll spacings produce yarns having good uniformity and mechanical properties. Nevertheless, there is always a need in the art to improve the uniformity and the mechanical properties of the yarn. Several attempts have been made to the drafting and spinning process to improve certain aspects of the spun yarn. For example, U.S. Pat. No. 5,481,863 to Ota describes decreasing the distance between the nip of the front roll pair of drafting rolls and the nip of the delivery rolls (located after spinning) to less than the longest fiber length to reduce ballooning in the air nozzles of the spinning apparatus. Additionally, U.S. Pat. No. 3,646,745 to Baldwin describes decreasing the distances between the nips of the front pair and the adjacent intermediate pair of drafting rolls to less than the effective staple length of the fibers in ring spinning processes to reduce the formation of "crackers" caused by overlength staple fibers. Nevertheless, no drafting takes place between the narrowly spaced rolls described in these patents and thus the problem of fiber breakage is not a danger in decreasing the roll spacings in these patents.

Co-pending parent application Ser. No. 08/844,463 ("the '463 application") discloses that the uniformity and mechanical properties of spun yarn, particularly air-jet spun yarn, can be greatly enhanced by drafting sliver through a four-roll drafting zone in which the distance between the back roll pair and the adjacent intermediate roll pair, were both no more than the effective fiber length of the longest fiber type in the sliver. Subsequent application Ser. No. 08/997,147 ("the '147 application") disclosed that yarn uniformity and mechanical properties can be similarly enhanced by maintaining the distance between the nip of intermediate roll pairs at no more than the effective fiber length of the longest fiber type in the sliver while maintaining a distance at the effective fiber length between the nip of the back roll pair and the nip of the adjacent intermediate roll pair.

One of the significant advantages of the inventions set forth in the '463 and '147 applications is the capability to produce high-quality yarns at very high spinning speeds; i.e., take-up speeds of more than 150 meters per minute in airjet apparatus. As known to those in this art, to date, most yarns produced in high-speed air-jet apparatus, although satisfactory for many purposes, do not match the quality for other purposes of yarns produced by open end ("rotor") spinning or classical ring spinning.

In this regard, those of skill in this art likewise recognize that the appearance and hand of knitting fabrics is generally somewhat more sensitive to yarn quality than woven fabrics. Stated differently, the looser construction of many knit fabrics particularly garments) tends to make imperfections more evident than they would be in woven fabrics formed from the same yarn.

Thus, a need exists for yarns that can be produced at high speeds (i.e., high productivity) with properties and characteristics that are suitable for the requirements of knit fabrics.

Applicants have now additionally discovered, however, that significantly improved knit fabric appearance and hand can be achieved by maintaining the distance between the nip of intermediate roll pairs at no more that 1.5 mm longer than the effective fiber length of the longest fiber type in the sliver while maintaining a distance no more than 2.5 mm longer than the effective fiber length between the nip of the back roll pair and the nip of the adjacent intermediate roll pair.

OBJECT AND SUMMARY OF THE INVENTION

Therefore, it is an object of the present invention to produce yarns suitable for knit fabrics at very high speeds while maintaining or increasing the quality of the yarns and the resulting knit fabrics as compared to more conventional techniques.

The invention meets this object with a method that comprises drafting a blended sliver of cotton fibers and polyester fibers in a four roll drafting zone in which the nip to nip spacing in the break zone is no more than 2.5 mm longer than the effective fiber length of the polyester fibers, and no more than 1.5 mm greater than the effective fiber length in the intermediate zone, and at least 7 mm greater than the effective fiber length in the front zone, thereafter spinning the drafted sliver into yarn at a take up speed of greater than 150 meters per minute; and thereafter knitting the spun yarn into fabric.

In another aspect, the invention comprises the improved yarns and knit fabrics that result from the method of the invention.

The foregoing and other objects and advantages of the invention and the manner in which the same are accomplished will become clearer based on the following detailed description taken in conjunction with the accompanying drawings in which:

DETAILED DESCRIPTION

Figure 1:
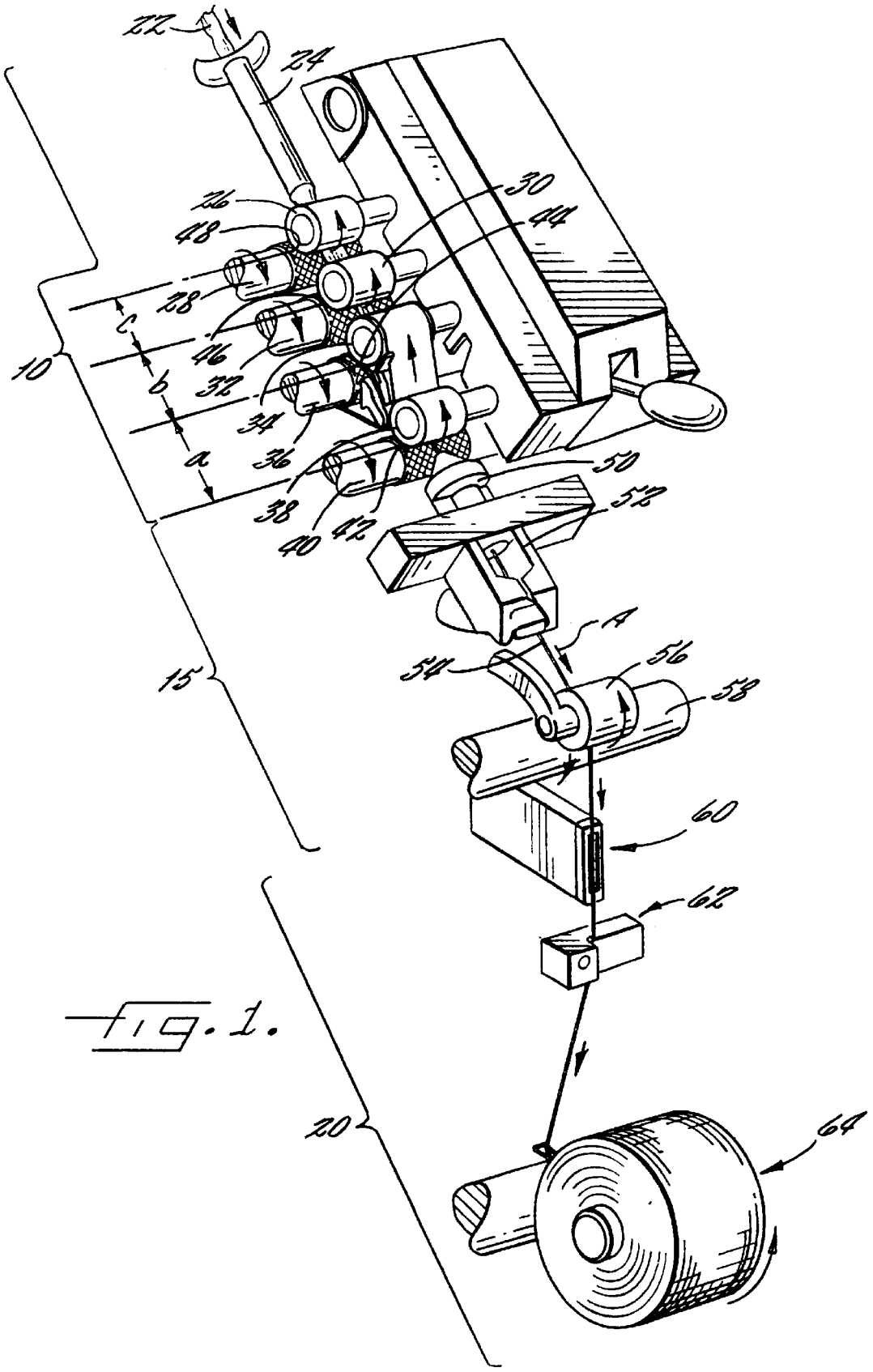
FIG. 1 is a perspective view of a drafting zone according to the present invention.

The present invention is a high efficiency method of producing a high quality knit fabric. The method comprises drafting a sliver that includes polyester fibers with an effective fiber length of 37 mm in a four roll drafting zone in which the nip-to-nip spacing is 39 mm in the break zone, 38.25 mm in the intermediate zone, and 46 mm in the front zone. The drafted sliver is then spun into yarn at a take up speed of greater than 150 meters per minute and the spun yarn is thereafter knitted into fabric. In preferred embodiments, the drafting step comprises drafting a blended sliver of cotton fibers and polyester fibers in which the nip-to-nip spacing in the break zone is no more than 2.5 mm longer than the effective fiber length of the polyester fibers, and no more than 1.5 mm greater than the effective fiber length in the intermediate zone, and at least 7 mm greater than the effective fiber length in the front zone. In the most preferred embodiments, the nip-to-nip spacing in the break zone is no more than 2.0 mm longer than the effective length of the polyester fibers and no more than 1.25 mm greater than the effective fiber length in the intermediate zone, and at least 9 mm greater than the effective length in the front zone.

As used herein, the effective fiber length has the same definition as set forth in prior applications Ser. No. 08/844,463 filed Apr. 18, 1997 and Ser. No. 08/997,147 filed Dec. 23, 1997. As thus defined, the effective fiber length is the mean decrimped fiber length of the fiber component prior to use in the sliver. The mean decrimped fiber length can be determined by fiber array testing of the fibers as described in ASTM method D-5103. As noted in the prior applications, however, staple fiber is very difficult to decrimp manually for ASTM D-5103. Accordingly, to ensure a more accurate determination of the effective fiber length, measurement of three-process drawn sliver containing 100% of the fiber to be studied is most recommended.

In preferred embodiment, the sliver is formed from polyester staple fibers that have a denier per filament of between about 0.5 and 2.5 dpf with filaments of between about 0.7 and 1.5 dpf being more preferred, and a filament of about 1.0 dpf being most preferred.

As indicated by the spinning speed of the method of the present invention, the step of spinning the sliver into yarn is preferably selected from the group consisting of air jet spinning means, vortex spinning means, and roller jet spinning means. In turn, take up speeds of at least about 190 meters per minute are more preferred, and take up speeds of at least about 220 meters per minute are most preferred.

As known to those familiar with recent developments in textile equipment, vortex spinning is a particular high speed spinning technique which is carried out on machinery such as Murata's model 851 MVS vortex spinning machine which has recently entered the commercial marketplace.

In preferred embodiments, the blended sliver consists of between about 10% and 100% by weight polyester fibers with the remainder being cotton fibers. Those of ordinary skill in this art will recognize that cotton and polyester are blended in a wide range of weight ratios with ratios of 65/35 or 50/50 "polyester/cotton" being quite common. The invention is quite useful with such blends.

In another aspect, the invention comprises the knitted fabric produced by the method, and garments produced from such knitted fabrics. In this regard, those familiar with the textile arts in general, and knitting in particular, will recognize that a wide variety of knitting patterns and techniques exist and that knitted fabrics fall into a wide variety of resulting categories including, but not limited to circular knits, double knits, flat knits, full fashioned, jersey, knitted fleece, knitted pile, knitted terry, milanese, raschel, rib knit, seamless knit, single knit, tricot, valor, warp knit, and weft knit. See, Tortora, *Fairchild's Dictionary of Textiles*, Seventh Edition (1996).

It will be further understood that as used herein the term "high quality" refers to the quality of the resulting knit fabric, regardless of the type of knit that is selected. In this regard, certain types of knit fabric are referred to as "high end," meaning that they are used in higher-priced fabrics and related products at the upper end of the commercial market. It will best be understood that the invention provides advantages for knit fabrics that also fall into more moderate commercial ranges.

Although the inventors do not wish to be bound by any particular theory, it has been hypothesized that the unevenness seen in certain knitted fabrics result from yarns that have been overdrafted or underdrafted, and that the consistent yarn quality produced by the present invention in turn produces more consistent knitted fabric.

FIG. 1 illustrates a drafting and spinning apparatus according to the invention. As shown in FIG. 1, the drafting and spinning apparatus may be divided into a drafting zone 10, a spinning zone 15, and a take-up zone 20.

In the operation of the drafting and spinning apparatus of the invention, a sliver 22 of staple fibers is advanced to the drafting zone 10. The sliver 22 may be processed prior to entering the drafting zone 10 using otherwise conventional steps such as opening, blending, cleaning, carding, and combing to provide the desired characteristics in the sliver for drafting and spinning. The sliver 22 used in the invention comprises one or more types of staple fibers, each staple fiber type having a predetermined effective fiber length.

For sliver blended with two fiber types with different length distributions, one should examine the appropriate portion of the third pass sliver length distribution which represents the longest fiber type present. For example, a blend of 50% nominal 1.5 inch Fortrel® polyester and 50% cotton three-process drawn sliver was examined. As known to those in this art, the actual length of any given fiber can differ slightly from its nominal length based on a number of factors.

To determine the effective fiber length in the sliver, the upper quartile length (i.e., the length for which 75% of the fibers are shorter and 25% are longer) was chosen. This length was selected because the cotton length distribution differs enough from the polyester length distribution to make a "mean" fiber length of the blend somewhat meaningless. Thus determining the mean length of the polyester portion of the sliver requires measuring the upper quartile length of the blend.

It will also be understood that blends that are the same composition by weight can, of course, differ in effective fiber length in one or more of the components of the blend. Nevertheless, those skilled in the art will be able to make similar selections for length measurement and without undue experimentation based on the nominal length of polyester or the type of cotton present in any particular blend, both which are generally known or indeed selected for such blends. It will be further understood that the goal is the measurement of the longest fibers in any blend and that in certain cases individual cotton (or other) fibers will be longer than the polyester fibers.

As shown in FIG. 1, the sliver 22 is advanced through a trumpet guide 24 which gathers the staple fibers together and then to a series of drafting roll pairs. The series of drafting roll pairs includes a pair of back rolls 26 and 28; at least one pair of intermediate rolls (FIG. 1 illustrates two pairs at 30 and 32, and 34 and 36); and a pair of front rolls 38 and 40. Preferably, as shown 15 in FIG. 1, the pair of intermediate rolls 34 and 36 adjacent the pair of front rolls 38 and 40 is a pair of apron rolls. For use in the invention, the series of drafting rolls preferably consists of at least four pairs or drafting rolls as, for example, the four roll pair arrangement illustrated in 20 FIG. 1. Nevertheless, the invention may also be applied to three roll pair arrangements having only one intermediate pair of drafting rolls.

Figure 2:
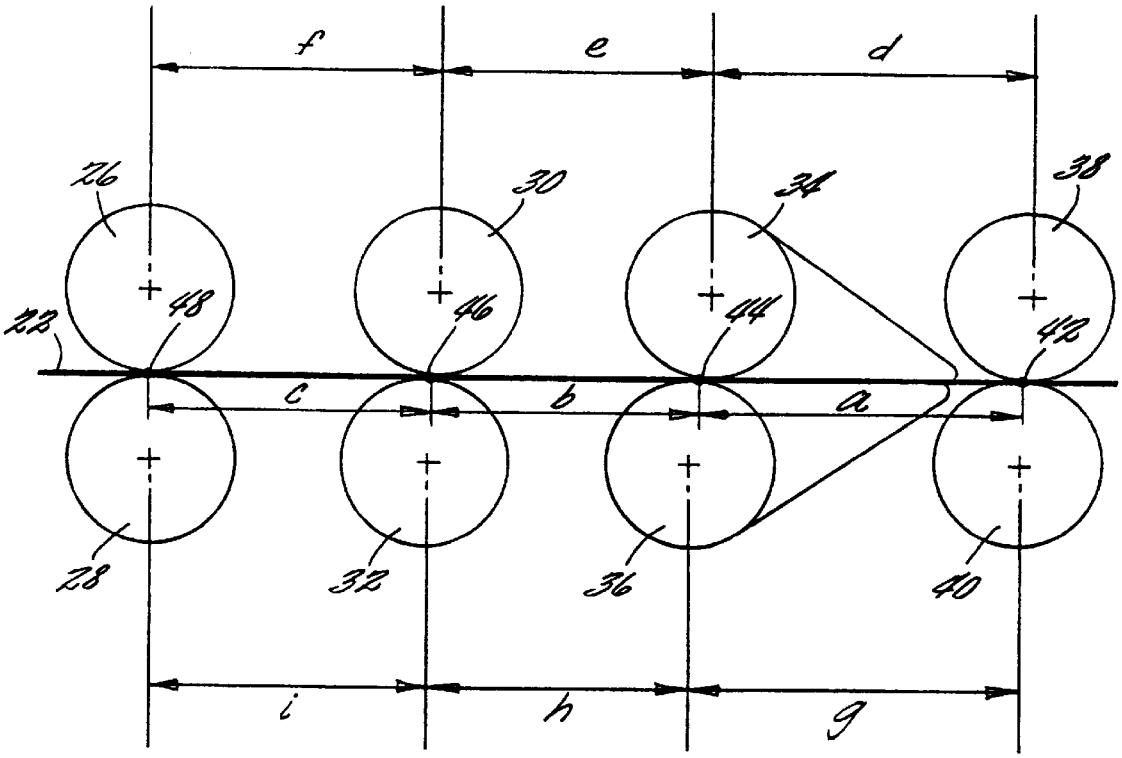
FIG. 2 is a side plan schematic view of a drafting zone according to the present invention.

The pairs of drafting rolls in the drafting zone 10 operate such that the speeds of the roll pairs increase in the direction of sliver movement as indicated, e.g., by directional arrow A, thereby drafting the sliver 22 down to yarn size. As illustrated in FIG. 1, typically the top roll 26, 30, 34 and 38 in the roll pair, rotates in a direction opposite that of the bottom roll 28, 32, 36 30 and 40 in the roll pair. As is well known to those skilled in the art, the ratio between the weight or length of the sliver 22 fed into the drafting zone 10 and the weight or length of the sliver exiting the drafting zone is known as the draft ratio. The draft ratio may also be measured across individual roll pairs such as the back draft (between the back rolls and the intermediate rolls), the intermediate draft (between the intermediate rolls and the apron rolls), and the main draft (between the apron rolls and the front rolls). Preferably, in the present invention, the overall draft ratio is between about 50 and about 220, and more preferably between about 130 and about 200. Typically, the majority of drafting occurs in the main draft. The width of the sliver 22 and thus the draft ratio may be affected by the speeds selected for the drafting rolls or a sliver guide (not shown) located between adjacent rolls pairs such as intermediate roll pairs 30 and 32, and 34 and 36. In the drafting zone 10, the distances between adjacent roll pairs or nips are typically preset depending on numerous factors including the staple fiber length, break draft and fiber cohesive forces. As illustrated in FIGS. 1 and 2, the distances between adjacent nips 42 (for the front roll pair), 44 (for the apron roll pair), 46 (for the intermediate roll pair), and 48 (for the back roll pair) are a, b, and c, respectively. The distance between nips may be fairly approximated by averaging the distance between adjacent top rolls and the distance between corresponding adjacent bottom rolls. For example, if the spacings (FIG. 2) between adjacent top rolls are d=48 mm, e=37 mm, and f=35 mm, respectively, and 25 the spacings between bottom rolls are g=44 mm, h=35 mm, and i=35 mm, respectively, than the distances a, b, and c, between adjacent nips would be a=46 mm, b=36 mm and c=35 mm. respectively. In addition to the roll spacings, various diameters for the drafting rolls may be selected for use in the invention and larger diameter rolls may be selected to further increase contact with the sliver 22 and thus increase the quality of the resulting spun yarn.

TABLE 1

| MJS Machine Setting Criteria<br>Sample Number | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| Finish Type | C | K | C | K | C | K | G | Control | C | K | C | K | G | C | K | Control |
| Fiber Length (mm) | 34 | 34 | 37 | 37 | 39 | 39 | 39 | 32 | 37 | 37 | 39 | 39 | 39 | 34 | 34 | 32 |
| Denier | 1.0 | | | | | | | | | | | | | | | |
| Cotton Type | Wellman | | | | | | | | | | | | | | | |
| Blend Percentage | 50/50 | | | | | | | | | | | | | | | |
| Sliver Weight | 55 | | | | | | | | | | | | | | | |
| Yarn Count | 20/1 | | | | | | | | | | | | | | | |
| Speed | 270 | | | | | | | | | | | | | | | |
| Total Draft | 132 | | | | | | | | | | | | | | | |
| Main Draft | 57 | | | | | | | | | | | | | | | |
| Intermediate Draft | 1.16 | | | | | | | | | | | | | | | |
| Break Draft | 2 | | | | | | | | | | | | | | | |

TABLE 1-continued

| MJS Machine Setting Criteria<br>Sample Number | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| Feed Ratio | 0.98 | | | | | | | | | | | | | | | |
| N1 Air Pressure | 1.5 | | | | | | | | | | | | | | | |
| N2 Air Pressure | 5 | | | | | | | | | | | | | | | |
| N1 Nozzle Type | H3 | | | | | | | | | | | | | | | |
| N2 Nozzle Type | H26 | | | | | | | | | | | | | | | |
| Condenser | 6 | | | | | | | | | | | | | | | |
| N1-F/R Distance | 40 | | | | | | | | | | | | | | | |
| Tensor Bar Height | 2.88 | | | | | | | | | | | | | | | |
| Front Roll Type | Day 99AL | | | | | | | | | | | | | | | |
| Apron Type | Hokushin | | | | | | | | | | | | | Teika | | |
| Apron Spring | 3 | | | | | | | | | | | | | | | |
| Apron Spacer | yes | | | | | | | | | | | | | no | | |
| Roller Spring Pressure | 16, 22, 22, 22 | | | | | | | | | | | | | | | |
| Side Plate | 48-37.5-39 | | | | | | | | 48-39-42 | | | | | 41-36-36 | | |
| Bottom Roll Setting | 44-39-39 | | | | | | | | 44-41.5-42 | | | | | 37-36-36 | | |
| Draft Line | 4 | | | | | | | | | | | | | | | |
| Trumpet | 9 | | | | | | | | | | | | | | | |
| Wax | No | | | | | | | | | | | | | | | |
| Nip-to-Nip | 46-38.25-39 | | | | | | | | 46-40.25-42 | | | | | 39-36-36 | | |

TABLE 2

| Sample Number | 1 | 2 | 3 | 4 | 5 | 6 | 7 | 8 |
|---|---|---|---|---|---|---|---|---|
| Finish Type | C | K | C | K | C | K | G | Control |
| Fiber Length | 34 | 34 | 37 | 37 | 39 | 39 | 39 | 32 |
| Side Plate | 48-37.5-39 | | | | | | | |
| Bottom Roll Setting | 44-39-39 | | | | | | | |
| Classimat Data | | | | | | | | |
| A-1 Defects (A1 – A2 – A3 – A4) | 27 | 46 | 44 | 103 | 97 | 59 | 115 | 54 |
| Major Defects (A4 + B4 + C3 + C4 + D3 + D4) | 0 | 0 | 0 | 0 | 24 | 0 | 0 | 0 |
| H-1 Defects | 1 | 0 | 14 | 179 | 0 | 0 | 13 | 15 |
| H-2 Defects | 0 | 0 | 14 | 0 | 0 | 0 | 7 | 8 |
| I-1 Defects | 1 | 18 | 14 | 102 | 6 | 7 | 13 | 23 |
| I-2 Defects | 1 | 12 | 14 | 76 | 6 | 7 | 13 | 15 |
| Long Thicks (E + F + G) | 0 | 0 | 0 | 0 | 6 | 0 | 0 | 8 |
| Statimat Data (100 breaks) | | | | | | | | |
| Yarn Count (Ne) | 20.36 | 20.02 | 20.41 | 20.26 | 20.15 | 20.04 | 19.98 | 20.42 |
| Mean Tenacity (g/d) | 1.31 | 1.17 | 1.36 | 1.26 | 1.56 | 1.39 | 1.49 | 1.14 |
| Minimum Tenacity (g/d) | 0.82 | 0.52 | 0.92 | 0.89 | 1.17 | 0.95 | 1.08 | 0.67 |
| Mean Single-End Strength (gf) | 343 | 311 | 355 | 330 | 411 | 369 | 397 | 298 |
| Single-End Strength CV (%) | 15.5 | 15.7 | 12.1 | 12.6 | 9.9 | 11.7 | 10.5 | 16.7 |
| Maximum Strength (gf) | 467 | 421 | 474 | 411 | 510 | 471 | 478 | 406 |
| Minimum Strength (gf) | 209 | 137 | 237 | 232 | 310 | 250 | 291 | 176 |
| Mean Single-End Elongation (%) | 8.9 | 7.9 | 9.0 | 8.2 | 9.4 | 8.4 | 9.2 | 8.2 |
| Elongation CV % | 13.6 | 14.4 | 10.6 | 11.6 | 8.2 | 9.4 | 8.8 | 15.5 |
| Maximum Elongation (%) | 11.5 | 10.3 | 11.0 | 10.3 | 11.1 | 10.5 | 11.2 | 10.9 |
| Minimum Elongation (%) | 5.5 | 3.0 | 6.5 | 5.8 | 7.1 | 6.5 | 6.7 | 5.3 |
| Uster 3 Yarn Evenness Data | | | | | | | | |
| Uster Evenness (CV %) | 13.8 | 14.0 | 14.5 | 14.6 | 14.4 | 14.3 | 14.3 | 13.9 |
| Uster 1 yd Evenness (CV %) | 3.4 | 3.6 | 3.5 | 3.7 | 3.8 | 4.0 | 4.0 | 3.6 |
| Uster 3 yd Evenness (CV %) | 2.3 | 2.5 | 2.4 | 2.6 | 2.6 | 2.8 | 2.8 | 2.5 |
| Uster 10 yd Evenness (CV %) | 1.5 | 1.6 | 1.6 | 1.7 | 1.7 | 1.7 | 1.7 | 1.6 |
| IPI Thin Places (−50%) | 3 | 5 | 6 | 4 | 4 | 2 | 4 | 4 |
| IPI Thick Places (+50%) | 88 | 107 | 142 | 149 | 136 | 127 | 112 | 97 |
| IPI Neps (+200%) | 106 | 124 | 128 | 136 | 168 | 168 | 148 | 130 |
| Total IPI's | 197 | 236 | 276 | 289 | 308 | 297 | 264 | 231 |
| EIB Hairiness | | | | | | | | |
| 1 mm hairs | 13001 | 13512 | 13092 | 12561 | 12946 | 13106 | 13450 | 13188 |
| 2 mm hairs | 2553 | 2927 | 1523 | 2473 | 2516 | 2832 | 2825 | 2622 |
| 3 mm hairs | 223 | 295 | 263 | 226 | 236 | 321 | 270 | 243 |
| 4 mm hairs | 9 | 17 | 8 | 11 | 11 | 14 | 15 | 175 |
| 5 mm hairs | 1 | 0 | 0 | 0 | 1 | 0 | 0 | 1 |
| 6 mm hairs | 0 | 0 | 0 | 0 | 0 | 0 | 0 | 0 |

TABLE 2-continued

| | | | | | | | | |
|---|---|---|---|---|---|---|---|---|
| Shirley Hairiness | | | | | | | | |
| Mean Hairs/meter | 13.7 | 13.7 | 15.1 | 13 | 15.2 | 13.3 | 15.8 | 13.9 |
| Std dev. | 1.4 | 1.1 | 2.8 | 1.5 | 1.6 | 1.9 | 1.8 | 1.6 |

| | 9 | 10 | 11 | 12 | 13 | 14 | 15 | 16 |
|---|---|---|---|---|---|---|---|---|
| Finish Type | C | K | C | K | G | C | K | Control |
| Fiber Length | 37 | 37 | 39 | 39 | 39 | 34 | 34 | 32 |
| Side Plate | 48-39-42 | | | | | 41-36-36 | | |
| Bottom Roll Setting | 44-41.5-42 | | | | | 37-36-36 | | |
| Classimat Data | | | | | | | | |
| A-1 Defects (A1 − A2 − A3 − A4) | 135 | 59 | 74 | 138 | 116 | 54 | 40 | 87 |
| Major Defects (A4 + B4 + C3 + C3 + D3 + D4) | 7 | 0 | 7 | 12 | 0 | 0 | 0 | 0 |
| H-1 Defects | 7 | 8 | 40 | 0 | 0 | 7 | 0 | 6 |
| H-2 Defects | 0 | 0 | 13 | 0 | 0 | 0 | 0 | 6 |
| I-1 Defects | 7 | 16 | 7 | 12 | 0 | 0 | 7 | 6 |
| I-2 Defects | 7 | 16 | 7 | 12 | 0 | 0 | 7 | 6 |
| Long Thicks (E + F + G) | 22 | 8 | 0 | 31 | 0 | 1 | 0 | 0 |
| Statimat Data (100 breaks) | | | | | | | | |
| Yarn Count (Ne) | 20.57 | 20.44 | 20.28 | 20.3 | 20.06 | 20.19 | 20.11 | 20.37 |
| Mean Tenacity (g/d) | 1.29 | 1.17 | 1.34 | 1.24 | 1.41 | 1.53 | 1.45 | 1.38 |
| Minimum Tenacity (g/d) | 0.7 | 0.64 | 0.77 | 0.58 | 0.5 | 1.01 | 1.11 | 0.78 |
| Mean Single-End Strength (gf) | 333 | 305 | 350 | 324 | 374 | 403 | 383 | 359 |
| Single-End Strength CV (%) | 15.9 | 15.7 | 15.9 | 16.9 | 15.1 | 11.2 | 9.8 | 11.9 |
| Maximum Strength (gf) | 442 | 401 | 443 | 447 | 469 | 504 | 462 | 454 |
| Minimum Strength (gf) | 182 | 167 | 202 | 152 | 129 | 266 | 291 | 204 |
| Mean Single-End Elongation (%) | 8.3 | 7.9 | 8.3 | 7.5 | 8.8 | 9.6 | 8.5 | 9.0 |
| Elongation CV % | 15.3 | 15.1 | 14.3 | 15.4 | 13.9 | 7.7 | 8.6 | 10.5 |
| Maximum Elongation (%) | 11.2 | 10.5 | 10.5 | 10.1 | 11.4 | 11.2 | 10.0 | 10.7 |
| Minimum Elongation (%) | 4.7 | 3.7 | 4.7 | 3.6 | 2.6 | 7.8 | 6.8 | 5.3 |
| Uster 3 Yarn Evenness Data | | | | | | | | |
| Uster Evenness (CV %) | 15.7 | 15.4 | 15.1 | 15.1 | 15.0 | 14.3 | 14.4 | 14.2 |
| Uster 1 yd Evenness (CV %) | 3.6 | 3.8 | 3.8 | 4.1 | 3.8 | 3.6 | 3.7 | 3.6 |
| Uster 3 yd Evenness (CV %) | 2.5 | 2.6 | 2.5 | 2.8 | 2.6 | 2.4 | 2.5 | 2.4 |
| Uster 10 yd Evenness (CV %) | 1.6 | 1.7 | 1.6 | 1.9 | 1.6 | 1.5 | 1.6 | 1.6 |
| IPI Thin Places (−50%) | 30 | 13 | 10 | 9 | 10 | 8 | 6 | 4 |
| IPI Thick Places (+50%) | 234 | 226 | 184 | 193 | 184 | 115 | 121 | 117 |
| IPI Neps (+200%) | 156 | 170 | 184 | 176 | 183 | 165 | 213 | 190 |
| Total IPI's | 420 | 409 | 378 | 378 | 377 | 288 | 340 | 311 |
| E/B Hairiness | | | | | | | | |
| 1 mm hairs | 12575 | 12619 | 12456 | 13998 | 13816 | 14260 | 13525 | 11792 |
| 2 mm hairs | 2422 | 2660 | 2433 | 3075 | 3065 | 3233 | 2865 | 2165 |
| 3 mm hairs | 225 | 244 | 225 | 298 | 297 | 295 | 279 | 195 |
| 4 mm hairs | 8 | 16 | 11 | 11 | 16 | 12 | 12 | 9 |
| 5 mm hairs | 1 | 0 | 0 | 0 | 1 | 1 | 0 | 1 |
| 6 mm hairs | 0 | 0 | 0 | 0 | 0 | 0 | 0 | 0 |
| Shirley Hairiness | | | | | | | | |
| Mean Hairs/meter | 13.7 | 13.3 | 15.6 | 13.4 | 16 | 13 | 12.8 | 16.1 |
| Std dev. | 1.6 | 1.5 | 1.9 | 2.8 | 2.4 | 1.5 | 1.8 | 1.5 |

TABLE 3

| MJS Machine Setting Criteria Sample Number | 1 | 2 | 3 | 4 | 5 | 6 | 7 | 8 |
|---|---|---|---|---|---|---|---|---|
| Finish | Control | | | | | | | |
| Fiber Length (mm) | 38 | | | | | | | |
| Denier | 1 | | | | | | | |
| Cotton Type | New WLM | | | | | | | |
| Blend Percentage | 50/50 | | | | | | | |
| Sliver Weight | 55 | | | | | | | |
| Yarn Count | 20 | | | | | | | |
| Speed | 270 | | | | | | | |
| Total Draft | 132 | | | | | | | |
| Main Draft | 57 | | | | | | | |
| Intermediate Draft | 1.16 | | | | | | | |
| Break Draft | 2 | | | | | | | |

TABLE 3-continued

| | | | | | | | | |
|---|---|---|---|---|---|---|---|---|
| Feed Ratio | 0.98 | | | | | | | |
| Takeup Ratio | 1 | | | | | | | |
| Traverse Speed | 810 | | | | | | | |
| N1 Air Pressure | 1.5 | 1.75 | 2 | 1.5 | 1.75 | 2 | 1.5 | 1.75 |
| N2 Air Pressure | 5 | | | | | | | |
| N1 Nozzle Type | H3 | | | | | | | |
| N2 Nozzle Type | H26 | | | | | | | |
| Condenser | Closed | | | | | | | |
| N1-F/R Distance | 40 | | | | | | | |
| Tensor Bar Height | 2.88 | | | | | | | |
| Front Roll Type | Day 99AL | | | | | | | |
| Apron Type | Hokushin | | | | | | Teika | |
| Apron Spring | 3 | | | | | | | |
| Apron Spacer | yes | | | | | | No | |
| Roller Spring Pressure | 16, 22, 22, 22 | | | | | | | |
| Side Plate | 48-37.5-39 | | | 48-37-36 | | | 41-36-36 | |
| Bottom Roll Setting | 44-39-39 | | | 44-37-38 | | | 37-36-36 | |
| Draft Line | 4 | | | | | | | |
| Trumpet | 9 | | | | | | | |
| Nip-toNip | 46-38.25-39 | | | 46-37-37 | | | 39-36-36 | |
| Wax | No | | | | | | | |

| MJS Machine Setting Criteria Sample Number | 9 | 10 | 11 | 12 | 13 | 14 | 15 | 19 | 20 | 21 |
|---|---|---|---|---|---|---|---|---|---|---|
| Finish | | C | | | K | | | Control | | |
| Fiber Length (mm) | | 37 | | | | | | 37 | | |
| Denier | | | | | | | | 1 | | |
| Cotton Type | | | | | | | | | | |
| Blend Percentage | | | | | | | | | | |
| Sliver Weight | | | | | | | | | | |
| Yarn Count | | | | | | | | | | |
| Speed | | | | | | | | | | |
| Total Draft | | | | | | | | | | |
| Main Draft | | | | | | | | | | |
| Intermediate Draft | | | | | | | | | | |
| Break Draft | | | | | | | | | | |
| Feed Ratio | | | | | | | | | | |
| Takeup Ratio | | | | | | | | | | |
| Traverse Speed | | | | | | | | | | |
| N1 Air Pressure | 2 | 1.5 | 1.75 | 2 | 1.5 | 1.75 | 2 | 1.5 | 1.75 | 2 |
| N2 Air Pressure | | | | | | | | | | |
| N1 Nozzle Type | | | | | | | | | | |
| N2 Nozzle Type | | | | | | | | | | |
| Condenser | | | | | | | | | | |
| N1-F/R Distance | | | | | | | | | | |
| Tensor Bar Height | | | | | | | | | | |
| Front Roll Type | | | | | | | | | | |
| Apron Type | | Hokushin | | | | | | | | |
| Apron Spring | | | | | | | | | | |
| Apron Spacer | | Yes | | | | | | | | |
| Roller Spring Pressure | | | | | | | | | | |
| Side Plate | | 48-37.5-39 | | | | | | 48-39-42 | | |
| Bottom Roll Setting | | 44-39-39 | | | | | | 44-41.5-42 | | |
| Draft Line | | | | | | | | | | |
| Trumpet | | | | | | | | | | |
| Nip-toNip | | 46-38.25-39 | | | | | | 46-40.25-42 | | |
| Wax | | | | | | | | | | |

TABLE 4

| Sample Number | 1 | 2 | 3 | 4 | 5 | 6 | 7 | 8 | 9 |
|---|---|---|---|---|---|---|---|---|---|
| Fiber Type | T472 | | | | | | | | |
| Finish | Control | | | | | | | | |
| Fiber Length (mm) | 38 | | | | | | | | |
| N1 Air Pressure | 1.5 | 1.75 | 2 | 1.5 | 1.75 | 2 | 1.5 | 1.75 | 2 |
| Side Plate | 48-37.5-39 | | | 48-37-36 | | | 41-36-36 | | |
| Bottom Roll Selling | 44-39-39 | 44-37-38 | | 37-36-36 | | | | | |
| Classimat Data | | | | | | | | | |
| A-1 Defects (A1 – A2) | 59 | 69 | 62 | 44 | 50 | 66 | 92 | 79 | 103 |
| Major Defects (A4 + B4 + C3 + C4 + D3 + D4) | 1 | 4 | 2 | 0 | 1 | 0 | 1 | 0 | 3 |
| H-1 Defects | 44 | 4 | 5 | 55 | 13 | 11 | 55 | 51 | 54 |

TABLE 4-continued

| | | | | | | | | | |
|---|---|---|---|---|---|---|---|---|---|
| H-2 Defects | 7 | 0 | 0 | 7 | 2 | 1 | 27 | 1 | 3 |
| I-1 Defects | 22 | 2 | 0 | 29 | 2 | 0 | 7 | 3 | 3 |
| I-2 Defects | 20 | 2 | 0 | 18 | 2 | 0 | 7 | 2 | 3 |
| Long Thicks (E + F + G) | 0 | 0 | 0 | 1 | 9 | 0 | 7 | 0 | 0 |
| Statimat Data (100 breaks) | | | | | | | | | |
| Yarn Count (Ne) | 20.24 | 20.39 | 20.45 | 19.78 | 19.72 | 19.75 | 19.7 | 19.65 | 19.7 |
| Mean Tenacity (g/d) | 0.98 | 1.14 | 1.3 | 1.19 | 1.41 | 1.48 | 1.09 | 1.24 | 1.18 |
| Second Minimum Tenacity | 0.55 | 0.75 | 0.75 | 0.57 | 0.83 | 1.1 | 0.76 | 0.78 | 0.64 |
| Minimum Tenacity (g/d) | 0.48 | 0.68 | 0.73 | 0.43 | 0.65 | 1.06 | 0.53 | 0.48 | 0.42 |
| Mean Single-End Strength (gf) | 259 | 299 | 337 | 321 | 380 | 399 | 295 | 335 | 321 |
| Single-End Strength CV (%) | 21.8 | 17.5 | 14.3 | 22.7 | 14.7 | 11.3 | 16.0 | 18.7 | 26.1 |
| Maximum Strength (gf) | 397 | 425 | 451 | 451 | 487 | 525 | 377 | 494 | 461 |
| Second Minimum Strength (gf) | 148 | 190 | 195 | 153 | 222 | 296 | 205 | 235 | 174 |
| Minimum Strength (gf) | 126 | 177 | 192 | 115 | 176 | 286 | 143 | 128 | 108 |
| Mean Single-End Elongation (%) | 6.8 | 7.8 | 8.7 | 7.3 | 8.4 | 9.0 | 6.7 | 7.9 | 8.1 |
| Elongation CV % | 20.3 | 14.7 | 12.4 | 19.8 | 12.2 | 9.1 | 15.5 | 11.5 | 12.1 |
| Maximum Elongation (%) | 9.6 | 10.3 | 10.9 | 9.6 | 10.3 | 10.6 | 8.9 | 9.3 | 9.8 |
| Minimum Elongation (%) | 3.4 | 5.2 | 4.9 | 2.1 | 3.9 | 6.8 | 2.9 | 4.7 | 4.5 |
| Uster 3 Yarn Evenness Data | | | | | | | | | |
| Uster Evenness (CV %) | 16.0 | 15.8 | 15.8 | 14.3 | 14.6 | 14.9 | 14.8 | 15.1 | 15.2 |
| Uster 1 yd Evenness (CV %) | 4.0 | 3.8 | 3.8 | 4.2 | 4.2 | 4.2 | 5.0 | 5.1 | 5.0 |
| Uster 3 yd Evenness (CV %) | 2.8 | 2.6 | 2.6 | 3.0 | 3.0 | 3.0 | 3.7 | 3.8 | 3.8 |
| Uster 10 yd Evenness (CV %) | 1.8 | 1.7 | 1.6 | 1.9 | 1.8 | 1.9 | 2.2 | 2.1 | 2.3 |
| IPI Thin Places (−50%) | 22 | 27 | 24 | 6 | 5 | 7 | 4 | 6 | 6 |
| IPI Thick Places (+50%) | 276 | 250 | 254 | 123 | 138 | 169 | 155 | 168 | 187 |
| IPI Neps (+200%) | 227 | 186 | 193 | 151 | 178 | 195 | 207 | 239 | 267 |
| Total IPI's | 525 | 463 | 471 | 280 | 321 | 371 | 366 | 413 | 460 |
| EIB Hairiness | | | | | | | | | |
| 1 mm hairs | 12887 | 13832 | 16245 | 16565 | 16082 | 16415 | 14202 | 14196 | 16492 |
| 2 mm hairs | 2681 | 2886 | 4956 | 4305 | 4133 | 4472 | 2872 | 5934 | 4346 |
| 3 mm hairs | 238 | 253 | 610 | 507 | 505 | 560 | 260 | 268 | 435 |
| 4 mm hairs | 14 | 9 | 36 | 28 | 29 | 31 | 12 | 13 | 18 |
| 5 mm hairs | 1 | 0 | 1 | 1 | 1 | 1 | 0 | 1 | 0 |
| 6 mm hairs | 0 | 0 | 0 | 0 | 0 | 0 | 0 | 0 | 0 |
| Shirley Hairiness | | | | | | | | | |
| Mean Hairs/meter | 13.6 | 12.6 | 12.8 | 14.6 | 19.5 | 15.7 | 12.7 | 10.9 | 11.7 |
| Std dev. | 1.8 | 1.8 | 1.5 | 0.6 | 2.4 | 1.0 | 1.7 | 0.7 | 1.1 |
| CV (%) | 13.4 | 14.6 | 11.5 | 4.4 | 12.5 | 6.5 | 13.4 | 6.8 | 9.4 |
| Sliver Data | | | | | | | | | |
| Rothschild card cohesion (cN) | 469.2 | | | | | | | | |
| Rothschild 3rd pass cohesion (cN) | 224.2 | | | | | | | | |

| Sample Number | 10 | 11 | 12 | 13 | 14 | 15 | 19 | 20 | 21 |
|---|---|---|---|---|---|---|---|---|---|
| Fiber Type | | | | | | | T472 | | |
| Finish | C | | | K | | | Control | | |
| Fiber Length (mm) | 37 | | | | | | 37 | | |
| N1 Air Pressure | 1.5 | 1.75 | 2 | 1.5 | 1.75 | 2 | 1.5 | 1.75 | 2 |
| Side Plate | 48-37.5-39 | | | | | | 48-39-42 | | |
| Bottom Roll Selling | 44-39-39 | | | | | | 44-41.5-42 | | |
| Classimat Data | | | | | | | | | |
| A-1 Defects (A1–A2) | 209 | 124 | 154 | 120 | 110 | 155 | 46 | 63 | 190 |
| Major Defects (A4 + B4 + C3 + C4 + D3 + D4) | 2 | 0 | 1 | 2 | 0 | 1 | 1 | 6 | 0 |
| H-1 Defects | 78 | 4* | 9 | 219 | 11 | 10 | 12 | 5 | 62 |
| H-2 Defects | 14 | 1 | 1 | 46 | 4 | 1 | 1 | 0 | 17 |
| I-1 Defects | 14 | 2 | 1 | 49 | 4 | 1 | 6 | 5 | 7 |
| I-2 Defects | 11 | 2 | 1 | 36 | 4 | 1 | 5 | 5 | 7 |
| Long Thicks (E + F + G) | 4 | 1 | 0 | 2 | 0 | 0 | 0 | 1 | |
| Statimat Data (100 breaks) | | | | | | | | | |
| Yarn Count (Ne) | 20.18 | 20.3 | 20.4 | 20.54 | 20.47 | 20.55 | 20.33 | 20.4 | 20.47 |
| Mean Tenacity (g/d) | 1.12 | 1.29 | 1.33 | 0.99 | 1.16 | 1.21 | 1.15 | 1.26 | 1.24 |
| Second Minimum Tenacity | 0.55 | 0.85 | 0.96 | 0.61 | 0.77 | 0.84 | 0.73 | 0.98 | 0.86 |
| Minimum Tenacity (g/d) | 0.53 | 0.8 | 0.92 | 0.58 | 0.67 | 0.53 | 0.41 | 0.75 | 0.74 |
| Mean Single-End Strength (gf) | 295 | 340 | 348 | 256 | 300 | 313 | 301 | 327 | 322 |
| Single-End Strength CV (%) | 19.1 | 14.5 | 13.6 | 19.8 | 17.6 | 16.0 | 18.3 | 11.9 | 13.3 |
| Maximum Strength (gf) | 405 | 474 | 464 | 376 | 421 | 406 | 403 | 417 | 417 |
| Second Minimum Strength (gf) | 144 | 219 | 253 | 156 | 199 | 218 | 192 | 255 | 222 |

TABLE 4-continued

| | | | | | | | | | |
|---|---|---|---|---|---|---|---|---|---|
| Minimum Strength (gf) | 137 | 209 | 240 | 149 | 172 | 137 | 107 | 192 | 193 |
| Mean Single-End Elongation (%) | 7.7 | 8.8 | 9.2 | 6.8 | 7.9 | 8.6 | 7.7 | 8.8 | 8.3 |
| Elongation CV % | 17.3 | 11.4 | 11.9 | 18.4 | 14.5 | 13.5 | 16.2 | 10.8 | 11.4 |
| Maximum Elongation (%) | 10.2 | 11.0 | 11.9 | 9.4 | 10.6 | 11.9 | 10.1 | 10.9 | 10.2 |
| Minimum Elongation (%) | 3.1 | 5.9 | 6.5 | 3.9 | 5.2 | 3.7 | 2.4 | 5.9 | 4.9 |
| Uster 3 Yarn Evenness Data | | | | | | | | | |
| Uster Evenness (CV %) | 16.1 | 16.0 | 16.3 | 16.1 | 16.3 | 16.7 | 16.1 | 16.2 | 16.3 |
| Uster 1 yd Evenness (CV %) | 4.0 | 3.9 | 4.4 | 4.0 | 4.0 | 3.9 | 3.8 | 3.8 | 3.9 |
| Uster 3 yd Evenness (CV %) | 2.8 | 2.7 | 3.4 | 2.8 | 2.8 | 2.7 | 2.6 | 2.5 | 2.7 |
| Uster 10 yd Evenness (CV %) | 1.9 | 1.7 | 2.3 | 1.8 | 1.8 | 1.6 | 1.6 | 1.6 | 1.7 |
| IPI Thin Places (−50%) | 33 | 28 | 37 | 34 | 36 | 46 | 37 | 46 | 40 |
| IPI Thick Places (+50%) | 282 | 274 | 296 | 289 | 319 | 379 | 272 | 313 | 310 |
| IPI Neps (+200%) | 238 | 250 | 272 | 250 | 290 | 370 | 183 | 231 | 242 |
| Total IPI's | 553 | 552 | 605 | 573 | 645 | 795 | 492 | 590 | 592 |
| EIB Hairiness | | | | | | | | | |
| 1 mm hairs | 13437 | 14152 | 13918 | 12585 | 13058 | 14639 | 14082 | 13374 | 13857 |
| 2 mm hairs | 2739 | 3002 | 3032 | 2523 | 2774 | 3550 | 3241 | 2813 | 3218 |
| 3 mm hairs | 257 | 270 | 292 | 235 | 145 | 352 | 598 | 301 | 303 |
| 4 mm hairs | 8 | 18 | 16 | 11 | 11 | 12 | 12 | 15 | 15 |
| 5 mm hairs | 0 | 1 | 0 | 1 | 0 | 1 | 0 | 2 | 1 |
| 6 mm hairs | 0 | 0 | 0 | 0 | 0 | 0 | 0 | 0 | 0 |
| Shirley Hairiness | | | | | | | | | |
| Mean Hairs/meter | 12.3 | 13.1 | 14.5 | 12.8 | 11.7 | 13.8 | 12.8 | 12.6 | 12.1 |
| Std dev. | 1.5 | 1.6 | 1.9 | 1.0 | 1.2 | 1.0 | 1.2 | 1.5 | 1.3 |
| CV (%) | 11.9 | 11.9 | 12.9 | 8.1 | 10.6 | 7.2 | 9.1 | 11.8 | 10.4 |
| Sliver Data | | | | | | | | | |
| Rothschild card cohesion (cN) | 537.5 | | | 557.1 | | | 469.2 | | |
| Rothschild 3rd pass cohesion (cN) | 243.4 | | | 254.3 | | | 224.2 | | |

Tables 1–4 describe the manner in which the yarns are spun and their resulting characteristics. Table 1 sets forth the spinning parameters for 16 yarn samples, all of which were carried out on a Murata MJS air jet spinning machine, Model 802H. For the sake of clarity, and to easily identify changes in the parameters, individual cells in the table are left blank whenever the value of the listed characteristic is identical to that of the left-adjacent cell (and often to the first listed characteristic in the row). Where the characteristic changes, the change is given in the cell and then the succeeding cells match the change until the next change is indicated.

Thus, in Table 1 the main differences were the finishes which are designated "C," "K," and "G," as internal designations for various high cohesion liquid finishes. Such finishes are otherwise well known in the art (e.g., U.S. Pat. No. 4,632,874 for "Filament Coherency Enhancing Composition And Textile Yarns Coated Therewith") or can be customized from known components without undue experimentation, and will not be described in detail further herein, except as necessary to highlight the invention. In preferred embodiments, a Rothschild card sliver cohesion of at least 469 cN is preferred. Table 1 thus also indicates that various fiber lengths were evaluated under three different sets of bottom roll settings. All of the parameters set forth in the first column of Table 1 are well understood in this art and will not be otherwise described in detail herein.

Table 2 gives the resulting characteristics of the same 16 samples as Table 1, with the fiber length and bottom roll setting repeated for the sake of clarity. The types of data reported in Table 2 are likewise well known to those of ordinary skill in this art, but as a brief summary, the "Classimat Data" evaluates yarn defects over a 100,000 meter sample of yarn and is a good indication of what a resulting fabric will look like after being made from such yarn. Similarly, the "Statimat Data" gives an indication of the yarn's strength, and the "Uster 3 Yarn Evenness Data" demonstrates the consistency of the yarn indicating thick and thin places. The electronic inspection board ("EIB Hairiness") is a relatively new test that uses an optical sensor to measure the "hairs" protruding from the yarn. In like manner, the "Shirley Hairiness" is a somewhat older conventional hairiness test that indicates some of the same properties.

Tables 3 and 4 summarize the same manufacturing parameters and results as did Tables 1 and 2, but for a different set of yarn samples. As indicated by the bold font in Table 4, Sample Number 11 appeared to offer the best results. For comparison purposes, Sample No. 10 in Table 4 corresponds to Sample No. 3 in Table 2. These two samples were, however, produced at two separate times using two different cotton samples.

Figure 3:
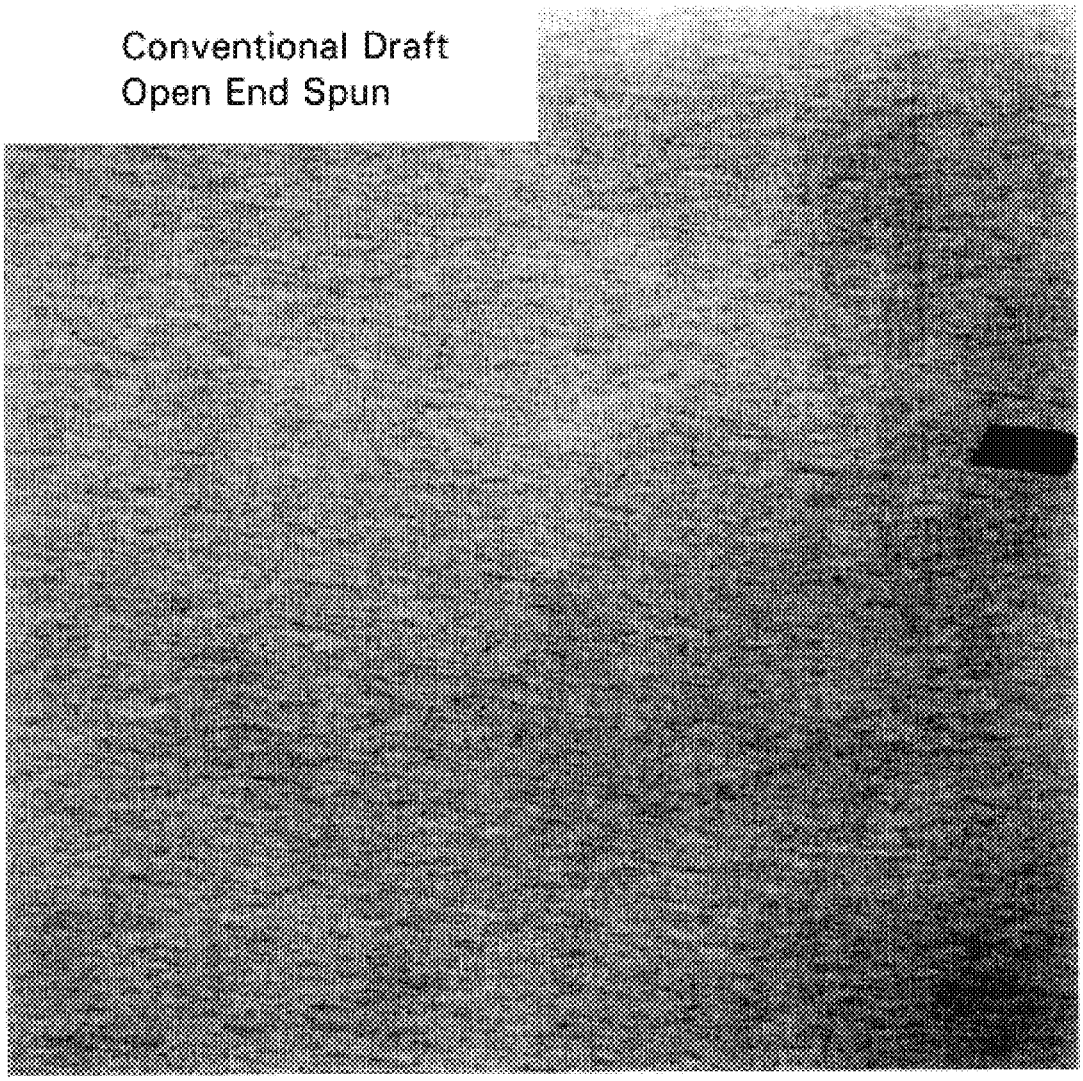
FIG. 3 is a photograph of a knit fabric formed from conventionally blended and drafted 20 Ne, 50/50 polyester/cotton rotor spun yarns.
Figure 4:
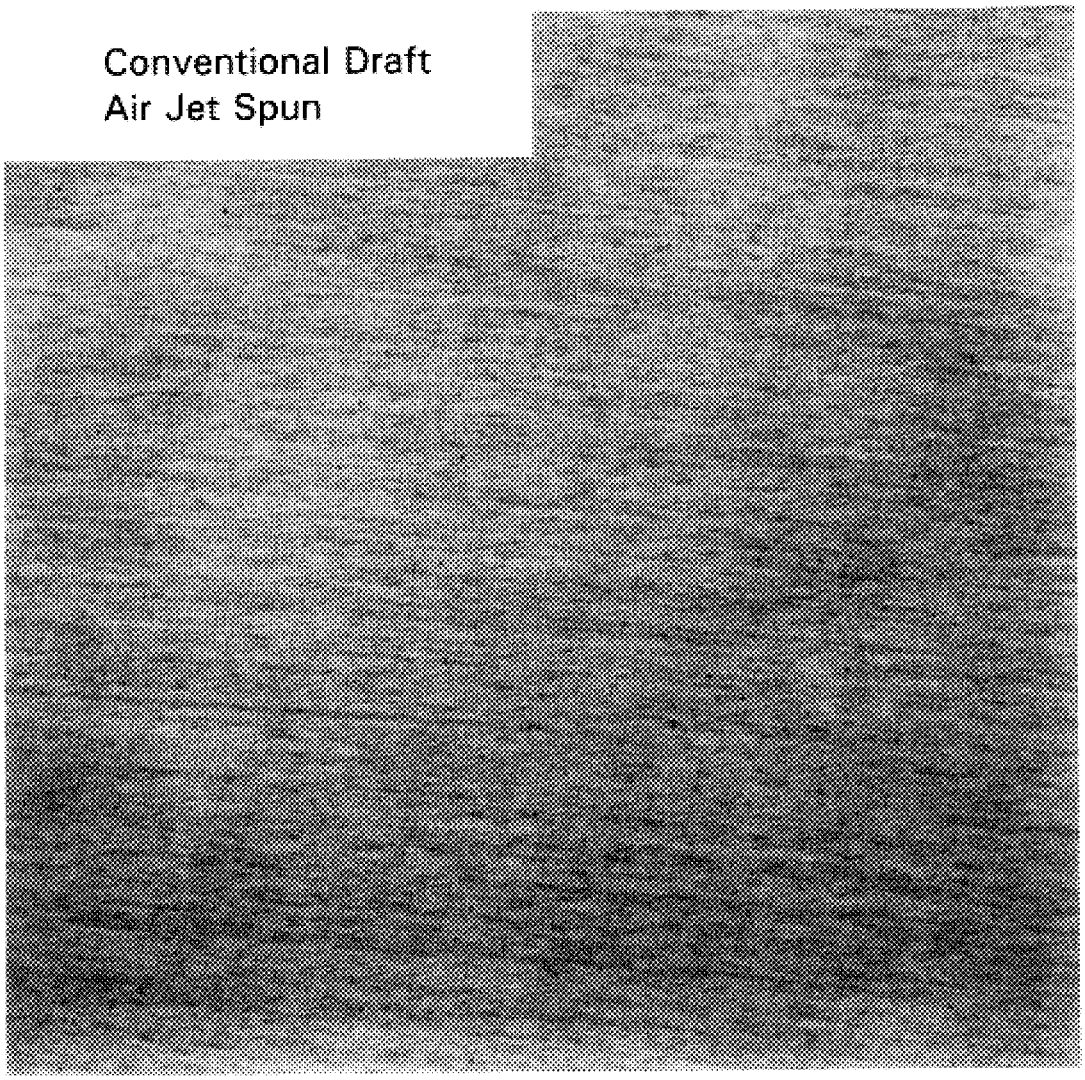
FIG. 4 is a photograph of an otherwise identically knit fabric, formed from conventionally blended and drafted 20 Ne, 50/50 polyester/cotton air-jet spun yarns.
Figure 5:
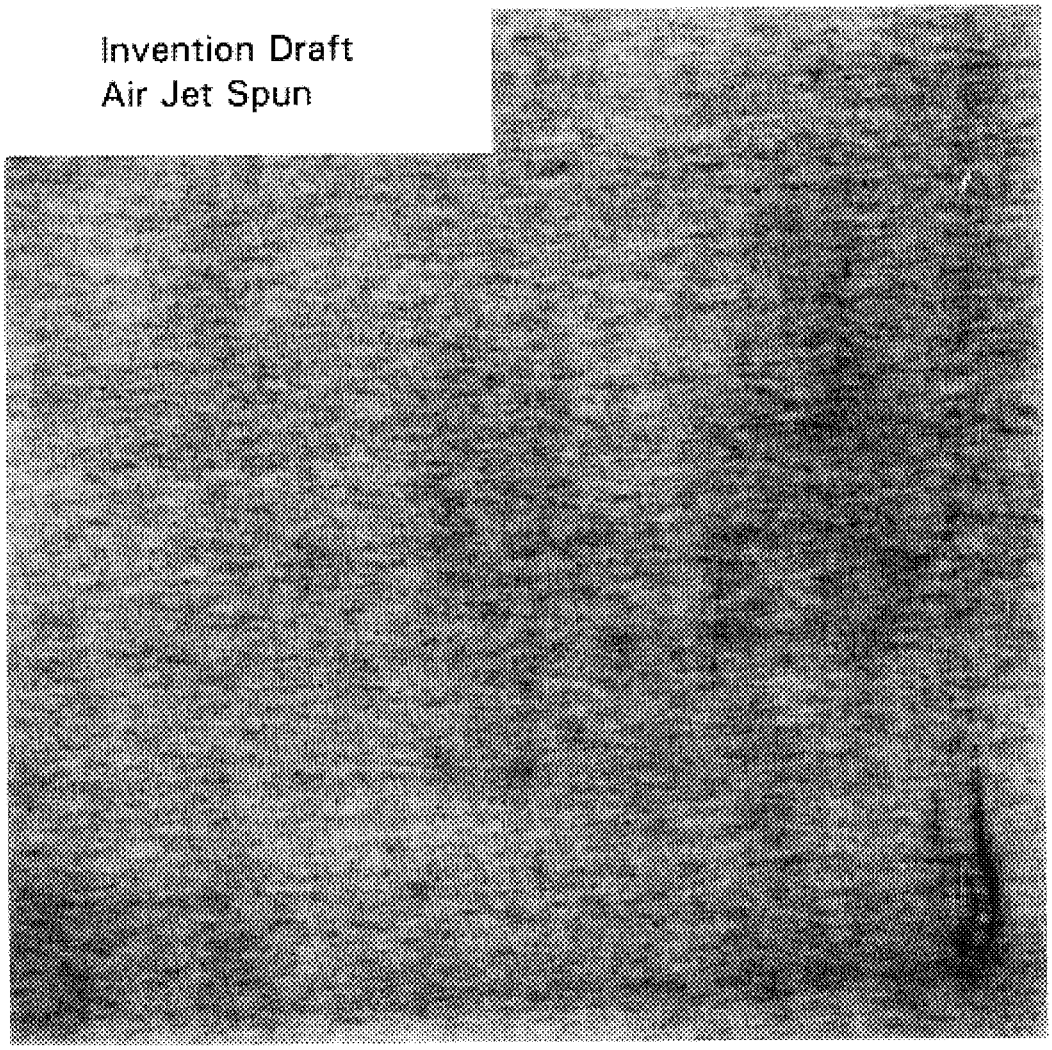
FIG. 5 is a photograph of an otherwise identically knit fabric, formed according to the present invention, including 20 Ne, 50/50 polyester/cotton air-jet spun yarns.

FIGS. 3, 4, and 5 are photographs showing fabrics with identical knit patterns and knit on the same machine, but with the yarn being spun by different techniques. FIG. 3 is a conventionally jersey-knit fabric of polyester and cotton yarns blended in a 50/50 weight ratio. The yarns were spun using a rotor technique. As is well known in the art, rotor-spun yarns are drafted somewhat differently from ring-spun or air jet-spun yarns.

By way of comparison, FIG. 4 is a knit fabric otherwise identical to that of FIG. 3 (same 50/50 yarns, same knitting pattern, same machine), but with the yarns being spun in an air jet technique. As noted previously, air-jet spun yarns can be produced much more quickly than can rotor spun yarns, but the characteristics of resulting fabrics suffer somewhat, particularly when the fabric is knitted rather than woven. In particular, FIG. 4 shows that the fabric includes a number of "long thick" portions that appear as darker streaks in the photograph and "long thin" portions that appear as the lighter streaks in the photograph. A comparison of FIGS. 3 and 4 shows that the fabric of FIG. 3 is much more consistent in its appearance than that of FIG. 4. Thus, as between FIGS. 3 and 4, the fabric of FIG. 4 can be produced at a higher rate (because air jet spinning is faster than open end spinning), but the fabric of FIG. 3 has generally more favorable characteristics. Thus to date, rotor spun yarns are more commercially acceptable for knit fabrics than are air jet spun yarns.

FIG. 5 illustrates a knitted fabric according to the present invention. The knit pattern and fiber composition (50/50 cotton/polyester by weight) is identical to FIGS. 3 and 4, but the yarns were drafted and spun according to the present invention. As FIG. 5 indicates, the invention greatly minimizes and indeed in many cases eliminates the long thick and long thin portions that are apparent in FIG. 4, while providing an overall consistent appearance that is at least as good as that of the fabric of FIG. 3. The hand of the fabric illustrated in FIG. 5 was also softer than that of the fabric of FIG. 4. Furthermore, because the yarns used to produce the fabric of FIG. 5 were airjet spun, the resulting fabric offers the productivity advantages of the fabric of FIG. 4, while maintaining the quality advantages of the fabric of FIG. 3.

Figure 6:
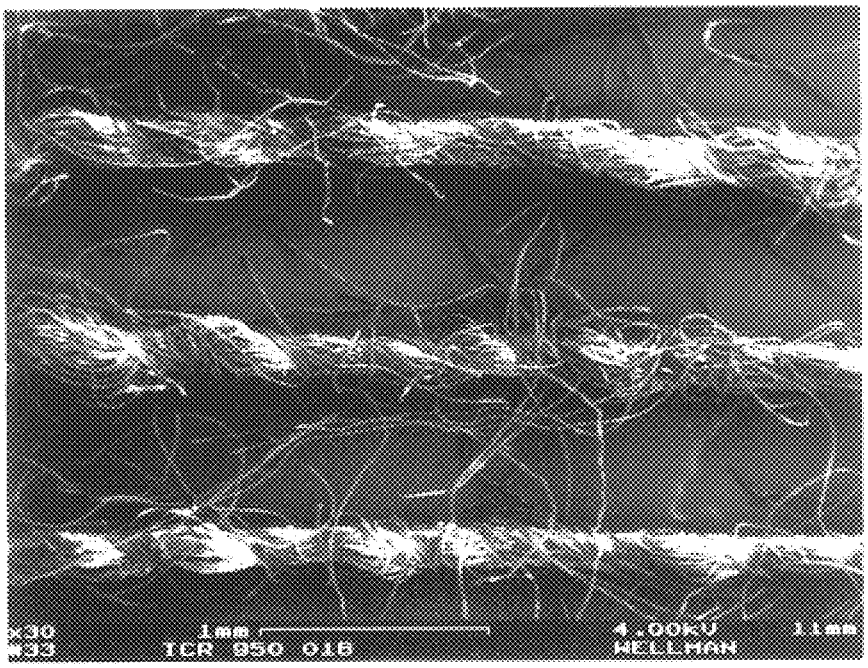
FIG. 6 is a photomicrograph of yarns blended, conventionally drafted and then spun.
Figure 7:
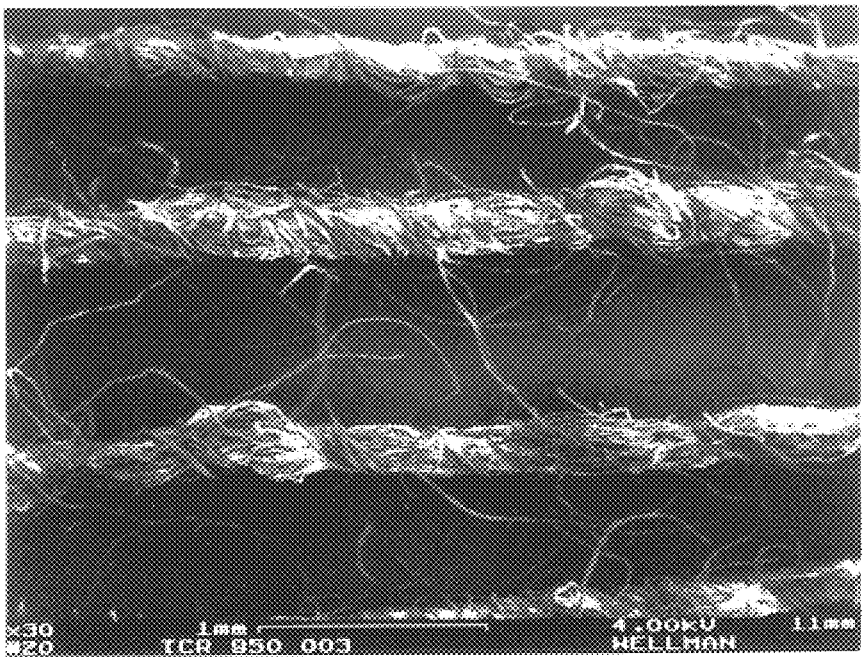
FIG. 7 is a photomicrograph of yarns blended, drafted and spun according to the present invention.

FIGS. 6 and 7 help illustrate the differences between yarns formed from previous techniques and those formed from the present invention. FIG. 6 is a photomicrograph (30× magnification) of Sample No. 16 from Table 1; i.e., a conventionally drafted, air jet spun yarn. As a comparison, FIG. 7 is a photomicrograph of yarn Sample No. 3 from Table 1, and which was drafted according to the present invention and then air jet spun. As these photomicrographs indicate, yarns produced according to the invention are generally larger in diameter and more consistent in diameter and related factors than are yarns produced in more conventional fashion. The larger diameter allows greater fabric cover which also minimizes the appearance of yarn defects. The more consistent diameter is believed to make the fabric hand softer because the yarn surface is more smooth. As noted earlier, these more favorable yarn characteristics appear to carry over to knitted fabrics that incorporate yarns produced according to the present invention.

Although the invention has been described and characterized in terms of polyester and cotton, it is expected that similar benefical results will be obtained from other syntheic and natural fibers. In this regard, the method can include using staple synthetic fibers that are selected from the group consisting of polyester, polytrimethylene terephthalate, rayon, nylon, acrylic, acetate, polyethylene, polyurethane and polyvinyl fibers. Similarly the method can include natural fibers that are selected from the group consisting of cotton, linen, flax, rayon, lyocell, viscose rayon, cellulose acetate, wool, ramie, alpaca, vicuna, mohair, cashmere, guanaco, camel, llama, fur and silk fibers.

In the drawings and specification, there have been disclosed typical embodiments of the invention, and, although specific terms have been employed, they have been used in a generic and descriptive sense only and not for purposes of limitation, the scope of the invention being set forth in the following claims.

What is claimed is:

1. A high efficiency method of producing a high quality knit fabric, the method comprising:

drafting a blended sliver of cotton fibers and polyester fibers in a four roll drafting zone that includes a break zone defined by the distance between a back roll pair and an intermediate roll pair, an intermediate zone defined by the distance between two intermediate roll pairs, and a front zone defined by the distance between a front roll pair and the adjacent intermediate roll pair, wherein the nip-to-nip spacing in the break zone is no more than 2.0 mm longer than the effective fiber length of the polyester fibers, the nip-to-nip spacing in the intermediate zone is no more than 1.25 mm greater than the effective fiber length of the polyester fibers, and the nip-to-nip spacing in the front zone is at least 9 mm greater than the effective fiber length of the polyester fibers;

thereafter spinning the drafted sliver into yarn at a take up speed of greater than 150 meters per minute; and thereafter knitting the spun yarn into fabric.

2. A method according to claim 1 and further comprising forming the sliver from a blend of cotton fibers and polyester prior to the step of drafting the sliver.

3. A method according to claim 1, wherein the step of drafting a blended sliver of cotton fibers and polyester fibers in a four roll drafting zone further comprise drafting a sliver in which the effective fiber length of the polyester is 37 mm and the 75th percentile of the cotton fibers is between about 28 and 30 mm.

4. A method according to claim 1, wherein the step of drafting a blended sliver of cotton fibers and polyester fibers in a four roll drafting zone further comprise drafting a sliver in which the polyester staple fibers have a denier per filament of between about 0.5 and 2.5 dpf.

5. A method according to claim 1, wherein the step of drafting a blended sliver of cotton fibers and polyester fibers in a four roll drafting zone further comprise drafting a sliver in which the polyester staple fibers have a denier per filament of between about 0.7 and 1.5 dpf.

6. A method according to claim 1, wherein the step of drafting a blended sliver of cotton fibers and polyester fibers in a four roll drafting zone further comprise drafting a sliver in which the polyester staple fibers have a denier per filament of about 1.0 dpf.

7. The method according to claim 1 wherein the step of spinning the sliver into yarn is selected from the group consisting of air jet spinning means, vortex spinning means, and roller jet spinning means.

8. The method according to claim 1, wherein the step of spinning the drafted sliver into yarn further comprises spinning the sliver into yarn at a take-up speed of at least about 190 m/min.

9. The method according to claim 1, wherein the step of spinning the drafted sliver into yarn filter comprises spinning the sliver into yarn at a take-up speed of at least about 220 m/min.

10. The method according to claim 1, wherein the step of drafting a blended sliver of cotton fibers and polyester fibers in a four roll drafting zone further comprises drafting the sliver with an overall draft ratio between about 50 and 220 over the back roll pair, the intermediate roll pairs, and the front roll pair.

11. The method according to claim 1, wherein the step of drafting a blended sliver of cotton fibers and polyester fibers in a four roll drafting zone further comprises drafting a sliver that includes high cohesion staple polyester fibers providing a Rothschild card sliver cohesion of at least 469 cN.

12. The method according to claim 11 comprising applying a high cohesion finish to the polyester staple fibers prior to the step of drafting the sliver.

13. The method according to claim 1, wherein the step of drafting a blended sliver of cotton fibers and polyester fibers in a four roll drafting zone further comprises drafting a sliver consisting of between about 10 and 100 percent polyester fibers with the remainder cotton fibers.

14. The method according to claim 1, wherein the step of drafting a blended sliver of cotton fibers and polyester fibers in a four roll drafting zone further comprises drafting a sliver of 50 percent by weight polyester fibers and 50 percent by weight cotton fibers.

15. A high efficiency method of producing a high quality knit fabric, the method comprising:

drafting a sliver that includes polyester fibers with an effective fiber length of 37 mm in a four roll drafting zone that includes a break zone defined by the distance between a back roll pair and an intermediate roll pair, an intermediate zone defined by the distance between intermediate roll pairs, and a front zone defined by the distance between a front roll pair and the adjacent intermediate roll pair, wherein the nip-to-nip spacing is 39 mm in the break zone, 38.25 mm in the intermediate zone and 46 mm in the front zone;

thereafter spinning the drafted sliver into yarn at a take up speed of greater than 150 meters per minute; and thereafter knitting the spun yarn into fabric.

16. A method according to claim 15, wherein drafting a sliver that includes polyester fibers with an effective fiber length of 37 mm in a four roll drafting zone further comprises drafting a sliver blended from cotton fibers and polyester staple fibers and wherein the 75th percentile length of the cotton fibers is between about 28 and 30 mm.

17. The method according to claim 15 wherein the step of spinning the sliver into yarn is selected from the group consisting of air jet spinning means, vortex spinning means, and roller jet spinning means.

18. The method according to claim 15, wherein the step of spinning the drafted sliver into yarn further comprises spinning the sliver into yarn at a take-up speed of at least about 190 m/min.

19. The method according to claim 15, wherein the step of spinning the drafted sliver into yarn further comprises spinning the sliver into yarn at a take-up speed of at least about 220 m/min.

20. The method according to claim 15, wherein drafting a sliver that includes polyester fibers with an effective fiber length of 37 mm in a four roll drafting zone further comprises drafting the sliver with an overall draft ratio between about 50 and 220 over the back roll pair, the intermediate roll pairs, and the front roll pair.

21. The method according to claim 15, wherein drafting a sliver that includes polyester fibers with an effective fiber length of 37 mm in a four roll drafting zone further comprises drafting a sliver that includes high cohesion staple polyester fibers.

22. The method according to claim 21 comprising applying a high cohesion finish to the polyester staple fibers prior to the step of drafting the sliver.

23. A method according to claim 15, wherein drafting a sliver that includes polyester fibers with an effective fiber length of 37 mm in a four roll drafting zone further comprises drafting a sliver in which the polyester staple fibers have a denier per filament of between about 0.5 and 2.5 dpf.

24. A method according to claim 15, wherein drafting a sliver that includes polyester fibers with an effective fiber length of 37 mm in a four roll drafting zone further comprises drafting a sliver in which the polyester staple fibers have a denier per filament of between about 0.7 and 1.5 dpf.

25. A method according to claim 15, wherein drafting a sliver that includes polyester fibers with an effective fiber length of 37 mm in a four roll drafting zone further comprises drafting a sliver in which the polyester staple fibers have a denier per filament of about 1.0 dpf.

26. The method according to claim 15, wherein drafting a sliver that includes polyester fibers with an effective fiber length of 37 mm in a four roll drafting zone further comprises drafting a sliver consisting of between about 10 and 100 percent polyester fibers with the remainder cotton fibers.

27. The method according to claim 15, wherein drafting a sliver that includes polyester fibers with an effective fiber length of 37 mm in a four roll drafting zone further comprises drafting a sliver of 50 percent by weight polyester fibers and 50 percent by weight cotton fibers.

28. The method according to claim 15, wherein drafting a sliver that includes polyester fibers with an effective fiber length of 37 mm in a four roll drafting zone further comprises drafting a sliver consisting of 100 percent polyester fibers.

29. A high efficiency method of producing a high quality knit fabric, the method comprising:

drafting a sliver that includes staple synthetic fibers with an effective fiber length of 37 mm in a four roll drafting zone that includes a break zone defined by the distance between a back roll pair and an intermediate roll pair, an intermediate zone defined by the distance between intermediate roll pairs, and a front zone defined by the distance between a front roll pair and the adjacent intermediate roll pair, wherein the nip-to-nip spacing is 39 mm in the break zone, 38.25 mm in the intermediate zone and 46 mm in the front zone;

thereafter spinning the drafted sliver into yarn at a take up speed of greater than 150 meters per minute; and thereafter knitting the spun yarn into fabric.

30. The method according to claim 29 wherein the staple synthetic fibers are selected from the group consisting of polyester, polytrimethylene terephthalate, rayon, nylon, acrylic, acetate, polyethylene, polyurethane and polyvinyl fibers.

31. The method according to claim 29, wherein the step of drafting a sliver that includes staple synthetic fibers further comprises drafting a sliver that includes natural fibers.

32. The method according to claim 31 wherein the natural fibers are selected from the group consisting of cotton, linen, flax, rayon, lyocell, viscose rayon, cellulose acetate, wool, ramie, alpaca, vicuna, mohair, cashmere, guanaco, camel, llama, fur and silk fibers.

* * * * *